US008305009B2

(12) United States Patent
Lee et al.

(10) Patent No.: US 8,305,009 B2
(45) **Date of Patent: *Nov. 6, 2012**

(54) INVERTER DRIVER AND LAMP DRIVER USING THE SAME

(75) Inventors: Dong-Hun Lee, Bucheon (KR); Jae-Soon Choi, Seoul (KR)

(73) Assignee: FAIRCHILD KOREA SEMICONDUCTOR, Ltd., Bucheon (KR)

( * ) Notice: Subject to any disclaimer, the term of this patent is extended or adjusted under 35 U.S.C. 154(b) by 629 days.

This patent is subject to a terminal disclaimer.

(21) Appl. No.: 12/398,030

(22) Filed: Mar. 4, 2009

(65) Prior Publication Data

US 2009/0224692 A1 Sep. 10, 2009

(30) Foreign Application Priority Data

Mar. 4, 2008 (KR) ..... 10-2008-0020136

(51) Int. Cl.
*H05B 41/36* (2006.01)

(52) U.S. Cl. ..... 315/294; 315/291; 315/209 R; 315/210; 315/297; 315/312; 315/320

(58) Field of Classification Search ..... 315/294
See application file for complete search history.

(56) References Cited

U.S. PATENT DOCUMENTS 6,008,593 A * 12/1999 Ribarich ..... 315/307
7,120,035 B2 * 10/2006 Lin et al. ..... 363/16
7,291,991 B2 * 11/2007 Chen ..... 315/307
7,414,371 B1 * 8/2008 Choi et al. ..... 315/291
7,560,879 B2 * 7/2009 Chen ..... 315/308
8,184,416 B2 * 5/2012 Choi et al. ..... 361/78
2006/0202635 A1 * 9/2006 Liu ..... 315/224
2007/0103096 A1 5/2007 Ren et al.
2007/0171684 A1 * 7/2007 Fukumoto ..... 363/21.09
2007/0278971 A1 12/2007 Ren et al.
2008/0024075 A1 1/2008 Henry
2009/0034138 A1 * 2/2009 Choi et al. ..... 361/78
2010/0019688 A1 * 1/2010 Choi et al. ..... 315/291

FOREIGN PATENT DOCUMENTS

KR 1020030055616 A 7/2003
KR 1020060020927 A 3/2006
WO WO 2008/006024 A2 1/2008

* cited by examiner

*Primary Examiner* — Jacob Y Choi
*Assistant Examiner* — Anthony Arpin
(74) *Attorney, Agent, or Firm* — Sidley Austin LLP

(57) ABSTRACT

An inverter driver controls an inverter that supplies driving voltages to a plurality of discharge lamps. The inverter driver includes a first amplifier having an output terminal, a second amplifier having an output terminal connected to the output terminal of the first amplifier, and a capacitor connected between the output terminal and a ground source. The first amplifier outputs only a negative current corresponding to the maximum value among the driving voltages supplied to the plurality of discharge lamps, and the second amplifier outputs a current corresponding to the maximum value among the driving currents flowing through the plurality of discharge lamps. Such inverter driver controls the inverter according to a voltage of the capacitor.

19 Claims, 6 Drawing Sheets

INVERTER DRIVER AND LAMP DRIVER USING THE SAME

CROSS-REFERENCE TO RELATED APPLICATION

This application claims priority to and the benefit of Korean Patent Application No. 10-2008-0020136 filed in the Korean Intellectual Property Office on Mar. 4, 2008, the entire contents of which are incorporated herein by reference.

BACKGROUND

1. Field of the Invention

The present invention relates to an inverter driver and a lamp driver including the same.

2. Description of the Related Art

In general, an inverter for an LCD backlight is a DC/AC converter for generating a high voltage to drive a cold cathode discharge lamp.

The inverter for transforming a DC power into an AC power can generate a driving voltage using a transformer that has a first side connected to a half bridge circuit or a full bridge circuit and a second side connected to a load side of a discharge lamp to drive the discharge lamp.

An inverter driver for driving such the inverter can include an amplifier for controlling the driving voltage when a feedback voltage corresponding to the driving voltage supplied to the discharge lamp is greater than a predetermined voltage. However, in some existing systems, when the feedback voltage is higher than the predetermined voltage, the amplifier may reduce an output current to maintain an output voltage, possibly even to zero Amperes. In such systems, the inverter driver cannot control the driving voltage of the discharge lamp with high precision.

The above information disclosed in this Background section is only for enhancement of understanding of the background of the invention and therefore it may contain information that does not form the prior art that is already known in this country to a person of ordinary skill in the art.

SUMMARY

Briefly and generally, embodiments include an inverter driver that can precisely control a driving voltage of a discharge lamp, and a lamp driver including the same.

An exemplary embodiment can include a lamp driver including a plurality of discharge lamps, an inverter, and an inverter driver. The inverter converts an input voltage to driving voltages supplied to the plurality of discharge lamps using switching elements. The inverter driver controls the inverter, and controls the driving voltages using a first maximum value among a plurality of first feedback voltages corresponding to the driving voltages applied to the plurality of discharge lamps, and a second maximum value among a plurality of second feedback voltages corresponding to driving currents flowing through the plurality of discharge lamps.

Another exemplary embodiment may include an inverter driver configured to drive an inverter for supplying driving voltages to a plurality of discharge lamps. The inverter driver includes a voltage detector, a current detector, a first amplifier, a second amplifier, a capacitor, and an output driver. The voltage detector detects a first maximum value from a plurality of first feedback voltages corresponding to the driving voltages supplied to the plurality of discharge lamps, and the current detector detects a second maximum value from a plurality of second feedback voltages corresponding to currents flowing through the plurality of discharge lamps. The first amplifier outputs a current corresponding to a difference between the first maximum and a first reference voltage, while the second amplifier outputs a current corresponding to a difference between the second maximum and a second reference voltage and has an output terminal connected to a output terminal of the first amplifier. The capacitor is connected between the output terminal of the second amplifier and a power source, and the output driver controls the inverter according to a voltage of the capacitor.

According to an exemplary embodiment, even if a feedback voltage corresponding to a driving voltage supplied to a discharge lamp is greater than a predetermined voltage, the inverter driver can precisely control the driving voltage of the discharge lamp.

DETAILED DESCRIPTION

Figure 1:
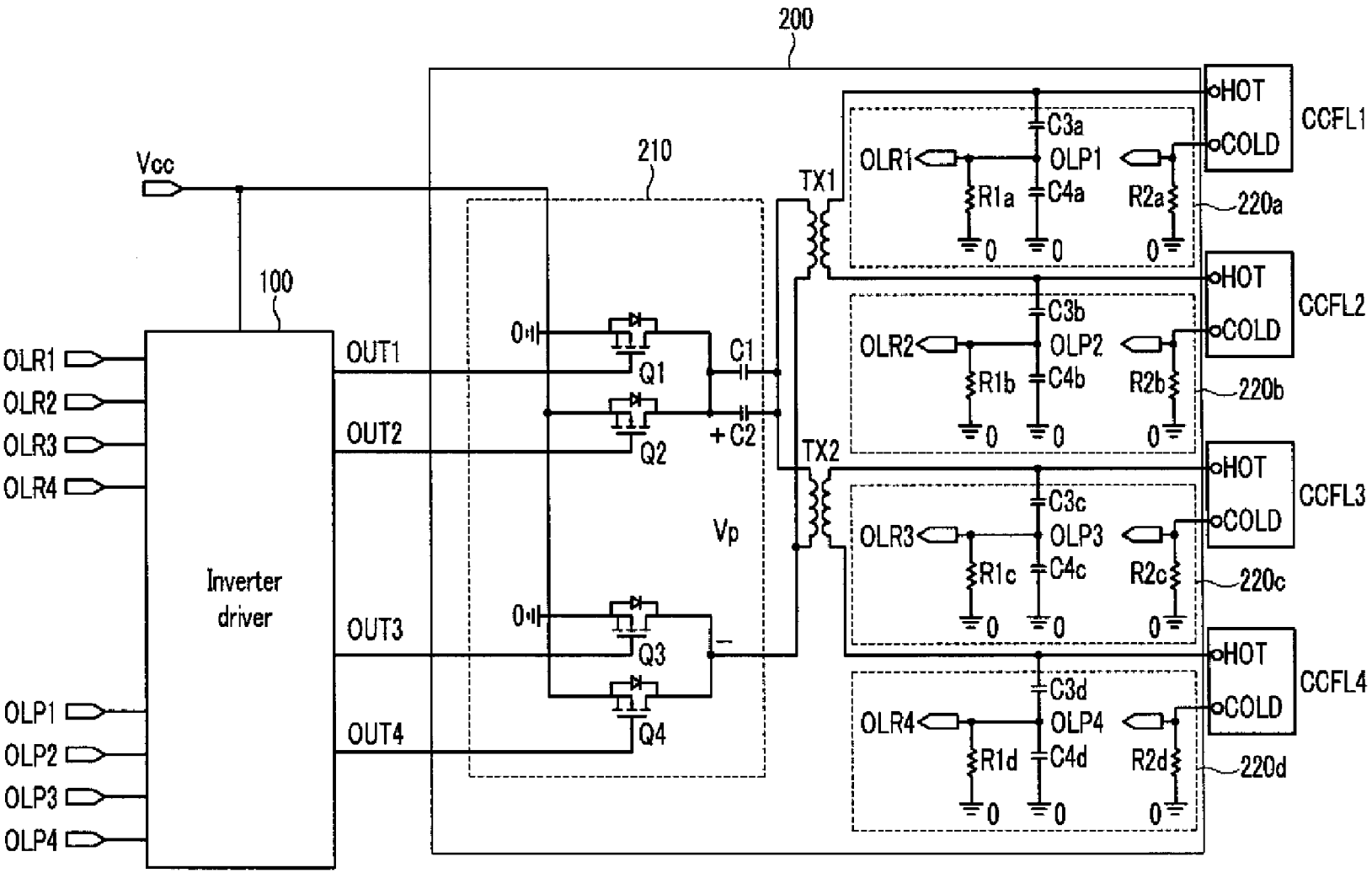
FIGS. 1 and 5 are block diagrams showing embodiments of a lamp driver.

In the following detailed description, only certain exemplary embodiments are shown and described, simply by way of illustration. As those skilled in the art realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element.

FIG. 1 is a block diagram showing a lamp driver. The lamp driver may include an inverter driver 100, an inverter 200, and discharge lamps CCFL1 to CCFL4.

The inverter driver 100 can output a control signal for controlling the turning on/off operation of switching elements of the inverter 200 when a DC voltage Vcc is inputted. The inverter driver 100 can receive driving voltages that are supplied to the discharge lamps CCFL1 to CCFL4 and a driving current that flows through the discharge lamps CCFL1 to CCFL4 as feedback, and can control a duty ratio of the control signal accordingly. A time of turning on/off the switching elements of the inverter 200 may be changed according to the duty ratio of the control signal, to control the driving voltages and the driving current.

The inverter 200 can generate the driving voltages from the DC voltage Vcc by turning on/off the switching elements, and can transmit the driving voltages to the discharge lamps CCFL1 to CCFL4.

The discharge lamps CCFL1-CCFL4 can respectively include a HOT terminal and a COLD terminal. The HOT terminal of the discharge lamp CCFL1 can be connected to the first end of the secondary coil of the transformer TX1, and the HOT terminal of the discharge lamp CCFL2 can be connected to the second end of the secondary coil of the transformer TX1. The HOT terminal of the discharge lamp CCFL3 can be connected to the first end of the secondary coil of the transformer TX2, and the HOT terminal of the discharge lamp CCFL4 can be connected to the second end of the secondary coil of the transformer TX2. The COLD terminals of the discharge lamps CCFL1 to CCFL4 can be corrected to a ground through the corresponding resistors R2. The discharge lamps CCFL1 to CCFL4 can be turned on by receiving a driving voltage generated by the transformers TX1 and TX2.

Next, the inverter 200 will be described in detail. The inverter 200 may include a switching circuit unit 210, transformers TX1 and TX2, and feedback units 220*a* to 220*d*. Embodiments of the switching circuit can be of the push-pull type, the half-bridge type, or the full-bridge type, among others. FIG. 1 shows a full-bridge type switching circuit.

The full-bridge type switching circuit unit 210 may include transistors Q1 to Q4 and capacitors C1 and C2. The fault-bridge circuit has two legs (left and right), one leg comprising transistors Q1 and Q2, the other leg comprising transistors Q3 and Q4. The transistors Q1 and Q3 can be N-channel transistors, and the transistors Q2 and Q4 can be P-channel transistors. In other embodiments, different architectures can be used. For example, transistors Q1 to Q4 can be N-channel transistors. The gates of the transistors Q1 to Q4 may be respectively connected to output terminals OUT1, OUT2, OUT3, and OUT4 of the inverter driver 100. A DC voltage Vcc can be input to sources of the transistors Q2 and Q4. Sources of the transistors Q1 and Q3 can be connected to the ground source. A drain of the transistor Q1 can be connected to a drain of the transistor Q2, and a drain of the transistor Q3 can be connected to a drain of the transistor Q4. The capacitors C1 and C2 can be connected in parallel between the drains of the transistors Q1 and Q2 and first terminals of the primary coils of the transformers TX1 and TX2. The drains of the transistors Q3 and Q4 can be connected to second terminals of the primary coils of the transformers TX1 and TX2. Resistors may be connected between a source of the transistor Q2 and a gate of the transistor Q2 and between a source of the transistor Q4 and a gate of the transistor Q4. Although two capacitors C1 and C2 are shown in parallel in FIG. 1, in other embodiments the number of capacitors can be one or more than two, connected in parallel or in series.

The transformers TX1 and TX2 can boost an AC voltage that is received from the switching circuit unit 210 e.g. with a square wave waveform and supply the boosted voltage to drive the discharge lamps CCFL1 to CCFL4. Hereinafter, the voltage boosted by the transformers TX1 and TX2 will be referred to as a driving voltage.

The switching circuit unit 210 may generate the square wave voltage by turning on/off the transistors Q1 to Q4. The transformers TX1 and TX2 boost the square wave voltage and generate a voltage with a sine wave waveform via a resonant action by the capacitors C3*a* to C3*d* and the transformers TX1 and TX2. The voltage of the sine wave may be supplied as the driving voltage to the discharge lamps CCFL1-CCFL4. The switching circuit unit 210 described in relation to FIG. 1 is but one embodiment, and other embodiments may include different switching circuit units.

Figure 2:
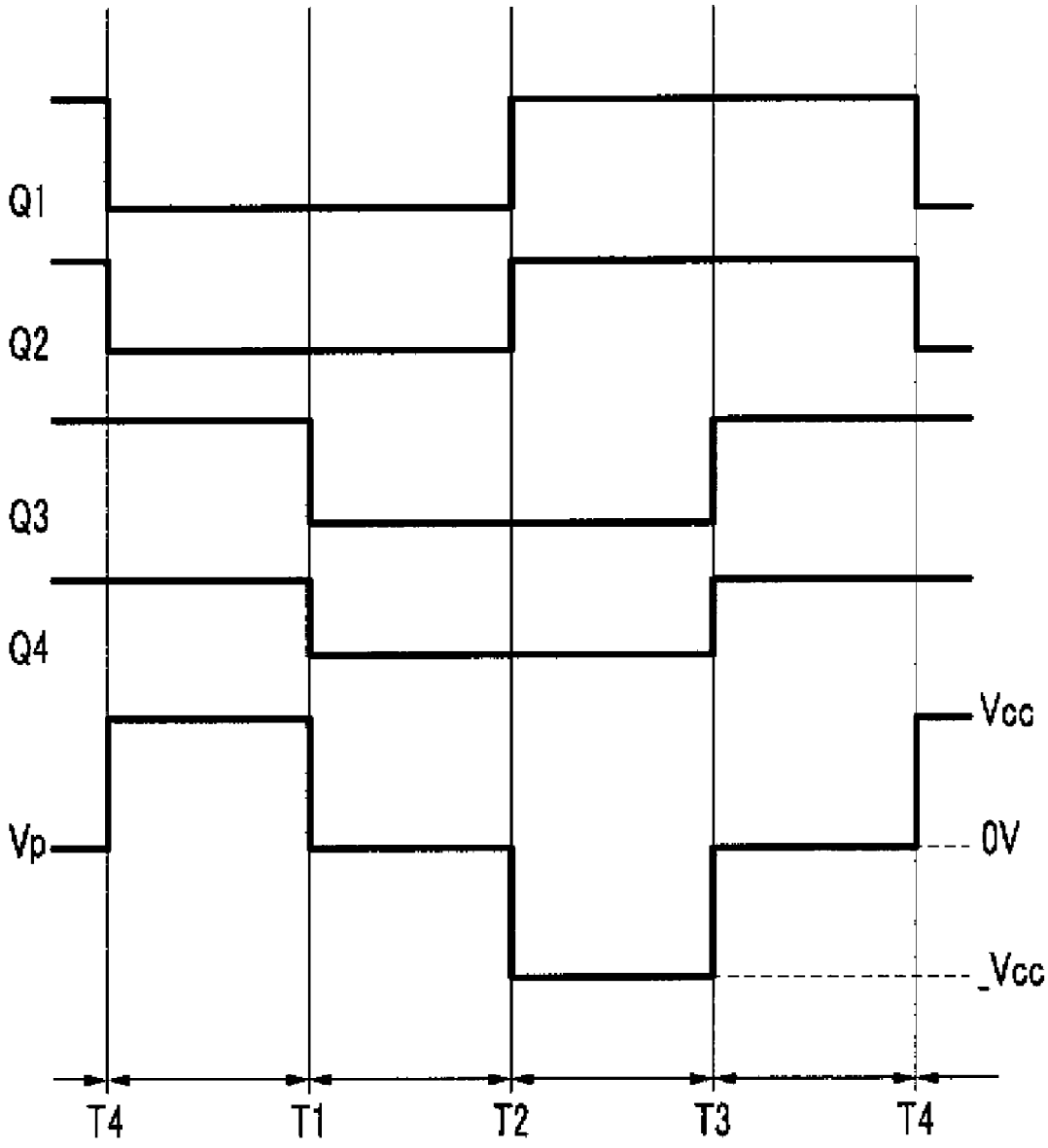
FIG. 2 is a timing diagram showing an operation of a switching circuit in a switching circuit unit shown in FIG. 1.

FIG. 2 is a timing diagram showing an operation of a switching circuit in the switching circuit unit shown in FIG. 1. During a period between time T4 and time T1, the transistors Q2 and Q3 can be turned on and the transistors Q1 and Q4 can be turned off in response to control signals from the output terminals OUT2, OUT3, OUT1, and OUT4 of the inverter driver 100, respectively. At time T4 a Vp voltage can be become the DC voltage Vcc. Here, the Vp voltage denotes a voltage between two coupled terminals of the capacitors C1 and C2 and two coupled terminals of the transformers TX1 and TX2. The Vp voltage is also equal to the differential voltage between a left leg's center and a right leg's center of the full-bridge. At time T4, a voltage between two terminals of the capacitors C1 and C2 can be almost 0V because the average of a square wave is 0V.

The square voltage is supplied to capacitors C1, C2, and transformers TX1, TX2. The DC component of the square wave is stored in capacitors C1 and C2 because the DC component of transformers TX1 and TX2 is 0V in steady state.

Between times T1 and T2, the transistors Q2 and Q4 can be turned on and the transistors Q1 and Q3 can be turned off in response to the control signals from the output terminals OUT2, OUT4, OUT1, and OUT3 of the inverter driver 100, respectively. At time T1, the Vp voltage can become essentially 0V.

Between times T2 and T3, the transistors Q1 and Q4 can be turned on and the transistors Q2 and Q3 can be turned off in response to the control signals from the output terminals OUT1, OUT4, OUT2, and OUT3 of the inverter driver 100, respectively. At time T2, the Vp voltage can become the negative of the DC voltage, i.e., −Vcc.

Between time T3 and time T4, the transistors Q1 and Q3 can be turned on and the transistors Q2 and Q4 can be turned off in response to the control signals from the output terminals OUT1, OUT3, OUT2, and OUT3 of the inverter driver 100, respectively. Then, the Vp voltage can become essentially 0V. The square wave voltage can be generated by repeatedly performing the operations described above in relation to times T1 to T4.

The feedback units 220*a* to 220*d* may feed driving voltages of the corresponding discharge lamps CCFL1 to CCLF4 and voltages corresponding to currents flowing through the discharge lamps CCFL1 to CCFL4 back to the inverter driver 100.

As an example, the feedback unit 220*a* may include capacitors C3*a* and C4*a*, and resistors R1*a* and R2*a*. The capacitors C3*a* and C4*a* may be connected in series between a HOT terminal of the discharge lamp CCFL1 and the ground source. A node between the capacitors C3 and C4 can be connected to the feedback terminal OLR1 of the inverter driver 100.

Thus, a voltage charged to the capacitors C3*a* and C4*a* can also be applied to the HOT terminal, which drives the discharge lamp CCFL1.

Figure 5:
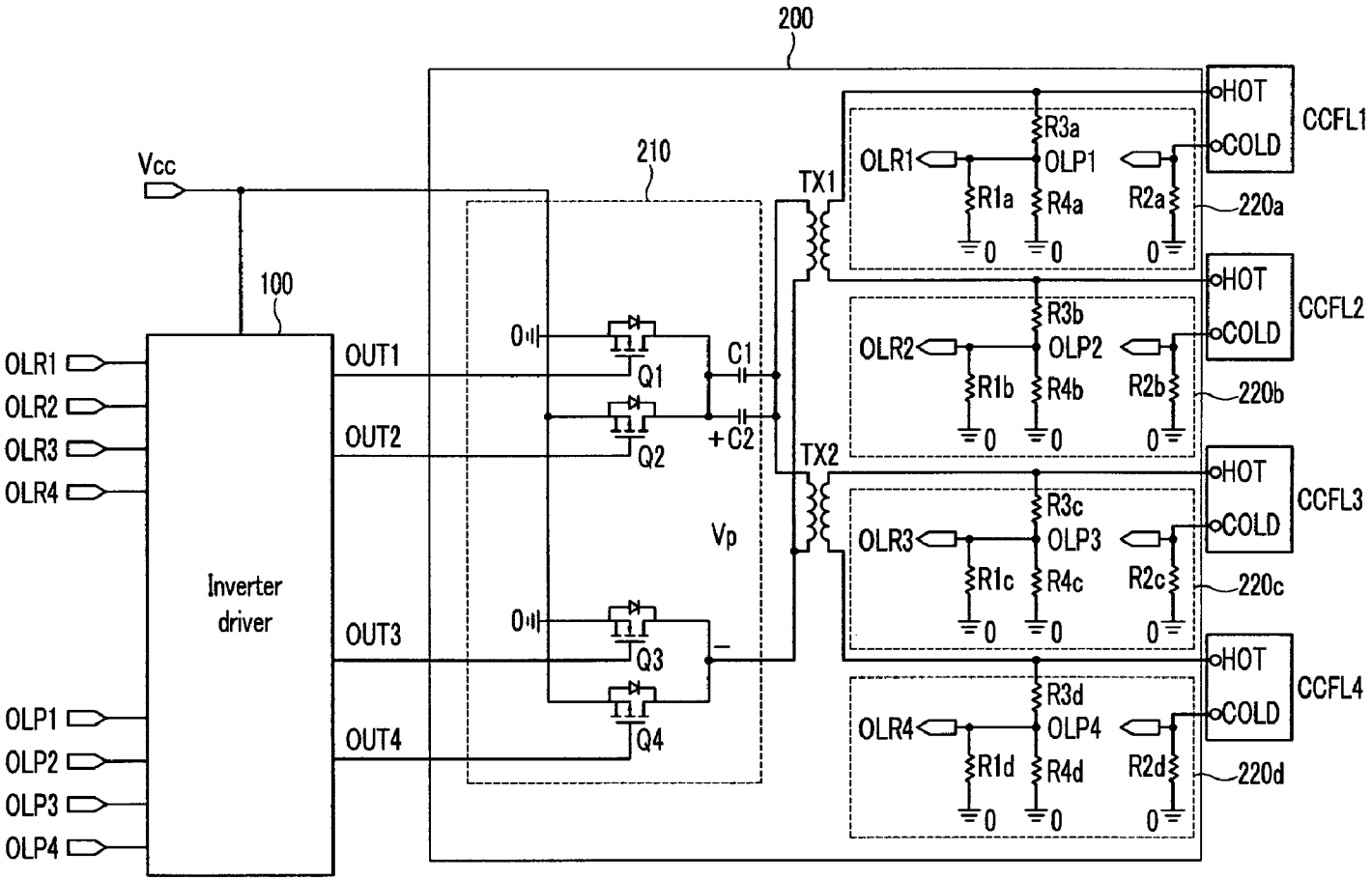

FIG. 5 is a block diagram, showing other embodiments of the lamp driver in which two resistors R3*a* and R4*a* may be connected in series between the HOT terminal of the discharge lamp CCFL1 and the ground source instead of the two capacitors C3*a* and C4*a*, and a voltage divided by the two resistors R3*a* and R4*a* may be input to the feedback terminal OLR1 of the inverter driver 100.

A resistor R1*a* may be connected between the node between the capacitors C3*a* and C4*a* and the ground source, and may be omitted in other embodiments. A resistor R2*a* may be connected between the COLD terminal of the discharge lamp CCFL1 and the ground source.

A node between the COLD terminal of the discharge lamp CCFL1 and the resistor R2*a* can be connected to the feedback terminal OLP1 of the inverter driver 100. Therefore, a voltage corresponding to a driving current flowing through the discharge lamp CCFL1 can be input to the feedback terminal OLP1 of the inverter driver 100. Equivalent designs can be applied to the other feedback units 220*b* to 220*d*. In some embodiments, the feedback units 220*b* to 220*d* can be essentially identical to the feedback unit 220*a*.

In the feedback units 220*b* to 220*d*, the nodes between the capacitors C3*b* to C3*d* and C4*b* to C4*d* may be respectively connected to the corresponding feedback terminals OLR2 to OLR4 of the inverter driver 100. Also, the nodes between the COLD terminal of the discharge lamps CCFL2 to CCFL4 and the resistors R2*b* to R2*d* can be connected to the feedback terminals OLP2 to OPL4 of the inverter driver 100. Hereinafter, driving voltages that are applied to the discharge lamps CCFL1 to CCFL4, divided by the capacitors C3 and C4, and input to the feedback terminals OLR1 to OLR4 will be referred to as first feedback voltages, and voltages corresponding to a current flowing through the discharge lamps CCFL1 to CCFL4 will be referred to as second feedback voltages.

Figure 3:
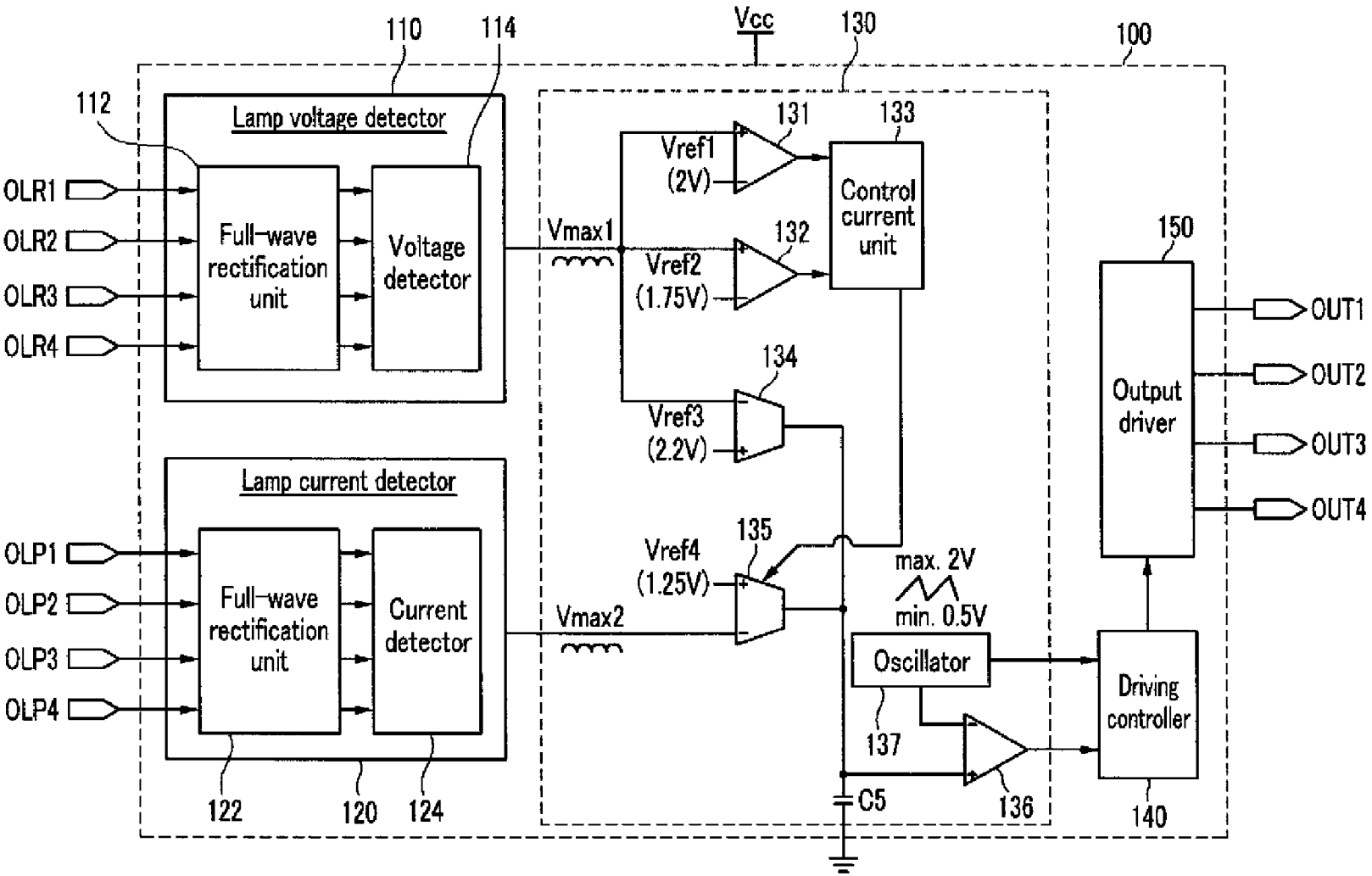
FIG. 3 is a drawing showing an inverter driver.
Figure 4A:
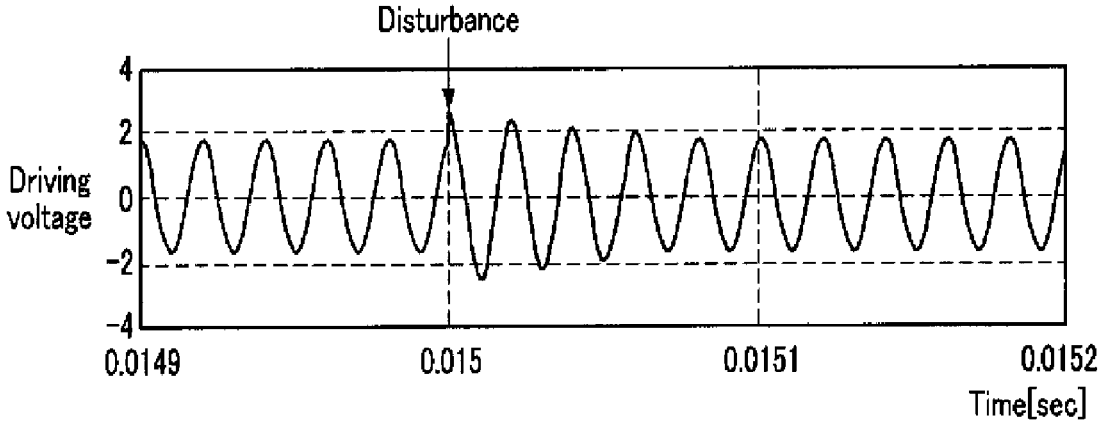
FIG. 4A is a drawing showing a driving voltage of a discharge lamp.
Figure 4B:
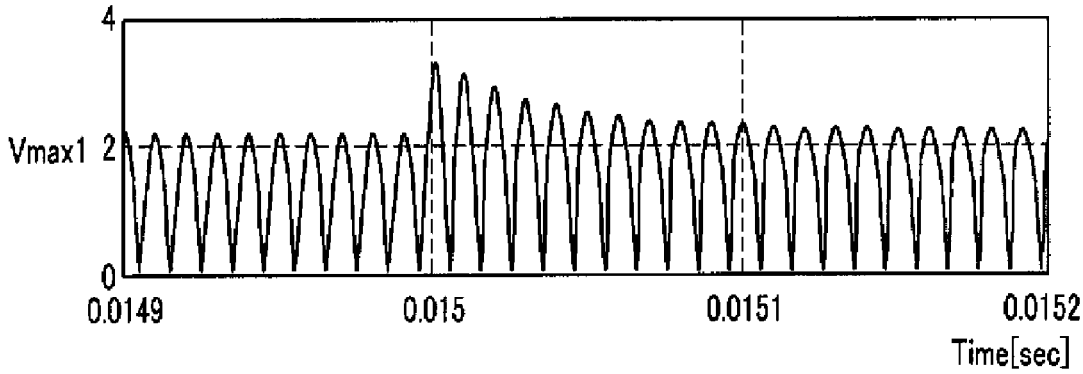
FIG. 4B is a drawing showing a first feedback voltage.
Figure 4C:
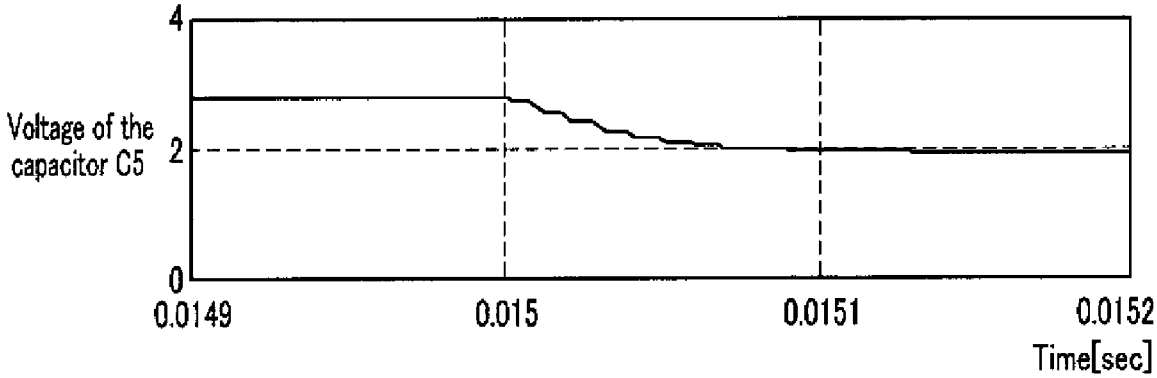
FIG. 4C is a drawing showing a voltage of the capacitor C5.

FIG. 3 illustrates an inverter driver. FIG. 4A to FIG. 4C illustrate a driving voltage of a discharge lamp, a first feedback voltage, and a voltage of the capacitor C5, respectively.

As shown in FIG. 3, the inverter driver 100 may include a lamp voltage detector 110, a lamp current detector 120, a driving voltage regulator 130, a driving controller 140, and an output driver 150.

The lamp voltage detector 110 may include a full-wave rectification unit 112 and a voltage detector 114. The full-wave rectification unit 112 can rectify the first feedback voltages input through the feedback terminals OLR1 to OLR4, and the voltage detector 114 can detect a maximum value Vmax1 of the rectified first feedback voltages.

The lamp current detector 120 may include a full-wave rectification unit 122 and a current detector 124. The full-wave rectification unit 122 can rectify the second feedback voltage input through the feedback terminals OLP1 to OLP4, and the current detector 124 can detect a maximum value Vmax2 of the rectified second feedback voltages. Since the second feedback voltages are voltages corresponding to currents that respectively flow through the discharge lamps CCFL1 to CCFL4, the lamp current detector 120 can detect the currents of the discharge lamps CCFL1 to CCFL4 as voltages.

The driving voltage regulator 130 can control the driving voltage of the discharge lamps CCFL1 to CCFL4 using the maximum values Vmax1 and Vmax2. The driving voltage regulator 130 may include comparators 131, 132, and 136, a control current unit 133, amplifiers 134 and 135, an oscillator 137, and a capacitor C5.

The comparator 131 can include a non-inverting terminal (+) for receiving the maximum value Vmax1, an inverting terminal (−) for receiving a reference voltage Vref1, and an output terminal connected to the control current unit 133.

The comparator 132 can include a non-inverting terminal (+) for receiving the maximum value Vmax1, an inverting terminal (−) for receiving a reference voltage Vref2, and an output terminal connected to the control current unit 133. The reference voltage Vref2 can be set lower than the reference voltage Vref1.

The control current unit 133 can control an output current of the amplifier 135 using an output pulse of the comparators 131 and 132. In detail, the control current unit 133 can control the output current of the amplifier 135 to be a predetermined current (e.g. 3 μA) when the maximum value Vmax1 is higher than the reference voltage Vref. Further, the control current unit 133 can control the output current of the amplifier 135 to be approximately 0 A to interrupt an operation of the amplifier 135 when the maximum value Vmax1 is higher than the reference voltage Vref1. As described above, when the reference voltages Vref1 and Vref2 are different, the control current unit 133 can prevent the output current instantaneously changing to 0 A when the maximum value Vmax1 becomes higher than the reference voltage Vref2 and then surpasses the reference voltage Vref1.

The amplifier 134 can include an inverting terminal (−) for receiving the maximum value Vmax1, and a non-inverting terminal (+) for receiving a reference voltage Vref3. The amplifier 135 can include an inverting terminal (−) for receiving the maximum value Vmax2, and a non-inverting terminal (+) for receiving a reference voltage Vref4. Further, an output terminal of the amplifier 134 can be connected to an output terminal of the amplifier 135, and the capacitor C5 can be connected between the output terminal of the amplifier 134 and the ground.

In some embodiments, the reference voltage Vref3 can be set higher than the reference voltage Vref1. For example the reference voltages Vref1, Vref2, Vref3 and Vref4 may be set to 2V, 1.75V, 2.2V and 1.25V. The reference voltage Vref4 can be set lower than the reference voltages Vref1, Vref2, and Vref3 in FIG. 3. In some embodiments, it may be set differently from what is shown in FIG. 3.

The amplifier 135 can output a current corresponding to a voltage difference between the non-inverting terminal (+) and the inverting terminal (−), and the amplifier 134 can output a negative current corresponding to a voltage difference between the non-inverting terminal (+) and the inverting terminal (−). The amplifiers 134 and 135 may be GM error amplifiers.

The amplifier 134 can control the driving voltage of the discharge lamps CCFL1 to CCFL4 using the maximum value Vmax1, and the amplifier 135 can control the driving current of the discharge lamps CCFL1 to CCFL4 using the maximum value Vmax2.

The comparator 136 can include a non-inverting terminal (+) connected to the output terminal of the amplifier 135, an inverting terminal (−) connected to the oscillator 137 and an output terminal connected to the driving controller 140. The comparator 136 can compare a voltage of the capacitor C5 and a triangle wave generated by the oscillator 137, and can output a driving pulse according to the result comparison.

The driving controller 140 can generate an output signal using the driving pulse of the driving controller 140 and the triangle wave generated from the oscillator 137, and can output the output signal to the output driver 150.

The output driver 150 can receive the output signal from the driving controller 140, generate the control signals for driving the transistors Q1 to Q4 of the switching circuit unit 210, and can supply a voltage and a current to the gate of the transistors Q1 to Q4 through the output terminals OUT1 to OUT4 according to the control signals to turn on/off the transistors Q1 to Q4. That is, the output driver 150 can control the duty ratio of the control signals according to the output signal of driving controller 140.

Here, when the voltages of the non-inverting terminals (+) of the amplifiers 134 and 135 are denoted as $V_+$, and the voltages of the inverting terminals (−) of the amplifiers 134 and 135 are denoted as $V_-$, an output current Igm may be determined by Equation 1:

$$I_{gm}=g_m(V_+-V_-) \tag{1}$$

Here, gm is a gain of the amplifiers 134 and 135.

According to Equation 1, when the voltage of the inverting terminal (−) of the amplifier 135 is lower than the voltage of the non-inverting terminal (+) of the amplifier 135, the amplifier 135 outputs a positive current, charging the capacitor C5. On the other hand, when the voltage of the inverting terminal (−) of the amplifier 135 is higher than the voltage of the non-inverting terminal (+) of the amplifier 135, the amplifier 135 outputs a negative current, discharging the capacitor C5. Also, when the voltage of the inverting terminal (−) of the amplifier 134 is higher than the voltage of the non-inverting terminal (+) of the amplifier 134, since the amplifier 134 outputs a negative current, the capacitor C5 is discharged.

When the capacitor C5 is charged, since the voltage of the capacitor C5 increases, a period in which the driving pulse output from the comparator 136 has a high level increases. Thus, the duty ratio of the transistors Q1 to Q4 increases, and the driving voltage supplied to the discharge lamps CCFL1 to CCFL4 increases. On the other hand, when the capacitor C5 is discharged, since the voltage of the capacitor C5 decreases, a period in which the driving pulse output from the comparator 136 has a high level decreases. Thus, the duty ratio of the transistors Q1 to Q4 decreases, and the driving voltage supplied to the discharge lamps CCFL1 to CCFL4 decreases.

However, the amplifier 134 outputs a negative current for discharging the capacitor C5 when the maximum value Vmax1 is higher than the reference voltage Vref3, and outputs a current of 0 A when the maximum value Vmax1 is below the reference voltage Vref3. As such, the amplifier 134 does not perform a control operation when the maximum value Vmax1 is below the reference voltage Vre3, and the amplifier 134 performs a control operation when the maximum value Vmax1 is higher than the reference voltage Vref3.

Also, when the maximum value Vmax1 is below the reference voltage Vref2, the control current unit 133 does not control the output current of the amplifier 135. Thus, when the maximum value Vmax1 is lower than the reference voltage Vref2, the driving voltage does not control according to the first feedback voltage, and the driving current may be controlled by an operation of the amplifier 135 according to the second feedback voltage.

The maximum value Vmax1 can be a value between the reference voltage Vref1 and the reference voltage Vref3, and since the control current unit 133 controls the output current of the amplifier 135 to essentially 0 A, the amplifier 135 does not perform a control operation. Further, since the maximum value Vmax1 is lower than the reference voltage Vref3, the amplifier 134 does not perform a control operation. Accordingly, when the maximum value Vmax1 is a value between the reference voltage Vref1 and the reference voltage Vref3, since this indicates operation within the range where the driving voltage is under control, the amplifier 134 needs not control the driving voltage.

As shown in FIG. 4B, when the maximum value Vmax1 is higher than the reference voltage Vref3 because of a fluctuation of the driving voltage as shown in FIG. 4A, since the control current unit 133 controls the output current of the amplifier 135 to essentially 0 A, the amplifier 135 does not perform a control operation. Further, when the amplifier 134 outputs a negative current, the voltage charged in the capacitor C5 is discharged. When the capacitor C5 is discharged, as shown in FIG. 4C, the voltage of the capacitor C5 decreases. Therefore, the duty ratio of the transistors Q1 to Q4 decreases and the driving voltage decreases. Since the voltage of the capacitor C5 decreases corresponding to the voltage difference between the non-inverting terminal (+) and the inverting terminal (−) of the amplifier 134, the driving voltage may decrease corresponding to the voltage difference between the reference voltage Vref3 and the maximum value Vmax1.

As described above, when the maximum value Vmax1 is higher than the reference voltage Vref3, the amplifier 134 can regulate the driving voltage. Since the voltage of the capacitor C5 may decrease corresponding to the voltage difference between the reference voltage Vref3 and the maximum value Vmax1 and the duty ratio may be controlled according to the voltage of the capacitor C5, the above described implementations may control the driving voltage of the discharge lamp CCFL1 to CCFL4 with high precision.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A lamp driver comprising:

a plurality of discharge lamps;

an inverter, configured to convert an input voltage to driving voltages using switching elements and to supply the driving voltages to the discharge lamps; and an inverter driver, configured to control the inverter and to control the driving voltages using a maximum voltage detector configured to detect a first maximum voltage value among a plurality of first feedback voltages corresponding to the driving voltages, and a maximum current detector configured to detect a second maximum voltage value among a plurality of second feedback voltages corresponding to driving currents flowing through the plurality of discharge lamps.

2. The lamp driver of claim 1, wherein the inverter driver comprises:

a first amplifier, configured to output a current corresponding to a difference between the first maximum voltage value and a first reference voltage;

a second amplifier, configured to output a current corresponding to a difference between the second maximum voltage value and a second reference voltage;

a capacitor, configured to connect to output terminals of the first and second amplifiers;

an oscillator, configured to generate a waveform having a predetermined period; and an output driver, configured to control a duty ratio of the switching elements using a voltage of the capacitor and the waveform generated by the oscillator.

3. The lamp driver of claim 2, wherein the inverter driver further comprises:

a comparator, configured to output a voltage according to the comparison of the voltage of the capacitor and the waveform generated by the oscillator to the output driver.

4. The lamp driver of claim 2, wherein the oscillator is configured to generate a triangle wave having a predetermined period.

5. The lamp driver of claim 2, wherein the first amplifier is configured to output a current for discharging the capacitor when the first maximum voltage value is higher than the first reference voltage.

6. The lamp driver of claim 5, wherein the first amplifier does not output a current when the first maximum voltage value is below the first reference voltage.

7. The lamp driver of claim 2, wherein the inverter driver further comprises:

a control current unit, configured to set the output current of the second amplifier to zero amps when the first maximum voltage value is higher than a third reference voltage, wherein the third reference voltage is lower than the first reference voltage.

8. The lamp driver of claim 7, wherein the control current unit is configured to set the output current of the second amplifier to a predetermined value when the first maximum voltage value is higher than a fourth reference voltage, and is lower than the third reference voltage.

9. The lamp driver of claim 2, wherein the inverter driver comprises:

a first full-wave rectification unit, configured to rectify the plurality of first feedback voltages and to output the rectified first voltages to the maximum voltage detector; and a second full-wave rectification unit, configured to rectify the plurality of second feedback voltages and to output the rectified second voltages to the maximum current detector.

10. The lamp driver of claim 2, wherein the inverter comprises:

a switching circuit unit, configured to generate a square wave voltage from the input voltage; and a transformer having a primary coil connected to the switching circuit unit and a secondary coil connected to the plurality of discharge lamps, and configured to convert the square wave voltage into the driving voltage.

11. The lamp driver of claim 10, wherein the switching circuit unit comprises:

first and second transistors connected in series between a power source supplying the input voltage and a ground source and having a node connected to a first end of the primary coil; and third and fourth transistors connected in series between the power source and the ground end and having a node connected to a second end of the primary coil.

12. The lamp driver of claim 2, wherein one of the plurality of first feedback voltages is a voltage divided by first and second capacitors that are connected in series to a first terminal of one of the plurality of discharge lamps, and one of the plurality of second feedback voltages corresponds to a voltage across a resistor connected to a second terminal of the one of the plurality of discharge lamps.

13. The lamp driver of claim 2, wherein one of the plurality of first feedback voltages is a voltage divided by first and second resistors that are connected in series to a first terminal of one of the plurality of discharge lamps, and one of the plurality of second feedback voltages corresponds to a voltage across a third resistor coupled to a second terminal of the one of the plurality of discharge lamps.

14. An inverter driver, configured to drive an inverter to supply driving voltages to a plurality of discharge lamps, the inverter driver comprising:

a maximum voltage detector, configured to detect a first maximum voltage value from a plurality of first feedback voltages corresponding to the driving voltages supplied to the plurality of discharge lamps;

a maximum current detector, configured to detect a second maximum voltage value from a plurality of second feedback voltages corresponding to currents flowing through the plurality of discharge lamps;

a first amplifier, configured to output a current corresponding to a difference between the first maximum voltage value and a first reference voltage;

a second amplifier, configured to output a current corresponding to a difference between the second maximum voltage value and a second reference voltage, and to have an output terminal connected to an output terminal of the first amplifier;

a capacitor, configured to connect between the output terminal of the second amplifier and a ground source; and an output driver, configured to control the inverter according to a voltage of the capacitor.

15. The inverter driver of claim 14, wherein the first amplifier is configured to output a current for discharging the capacitor when the first maximum voltage value is higher than the first reference voltage, and to output no current when the first maximum voltage value is below the first reference voltage.

16. The inverter driver of claim 15, further comprising:

a comparator, configured to compare the first maximum voltage value and a third reference value that is lower than the first reference voltage; and a control current unit, configured to set the output current of the second amplifier to zero amps when the first maximum voltage value is higher than the third reference voltage.

17. The inverter driver of claim 16, further comprising:

a second comparator, configured to compare the first maximum voltage value and a fourth reference value that is lower than the third reference voltage, wherein the control current unit is configured to set the output current of the second amplifier to a predetermined value when the first maximum voltage value is higher than the fourth reference voltage.

18. The inverter driver of claim 15, wherein the second amplifier is configured to output a current for discharging the capacitor when the second maximum voltage value is higher than the second reference voltage, and to output a current for charging the capacitor when the second maximum voltage value is below the second reference voltage.

19. The inverter driver of claim 15, further comprising:

an oscillator, configured to generate a waveform having a predetermined period; and a comparator, configured to output a voltage according to the comparison of the voltage of the capacitor and the waveform generated by the oscillator to the output driver.

* * * * *